US007806186B2

(12) United States Patent
Brown et al.

(10) Patent No.: US 7,806,186 B2
(45) Date of Patent: Oct. 5, 2010

(54) SUBMERSIBLE PUMP WITH SURFACTANT INJECTION

(75) Inventors: Donn J. Brown, Broken Arrow, OK (US); Brown Lyle Wilson, Tulsa, OK (US); David H. Neuroth, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 200 days.

(21) Appl. No.: 11/956,968

(22) Filed: Dec. 14, 2007

(65) Prior Publication Data

US 2009/0151953 A1 Jun. 18, 2009

(51) Int. Cl.
*E21B 43/01* (2006.01)

(52) U.S. Cl. ..... 166/335; 166/369; 166/268; 166/270.01; 166/309; 166/68; 166/105; 166/105.5

(58) Field of Classification Search ..... 166/335, 166/339, 344, 347, 348, 351, 368, 369, 370, 166/372, 381, 268, 270.01, 309, 68, 68.5, 166/105, 105.5

See application file for complete search history.

(56) References Cited

U.S. PATENT DOCUMENTS

| | | | | | |
|---|---|---|---|---|---|
| 4,665,981 | A * | 5/1987 | Hayatdavoudi | ..... | 166/250.05 |
| 4,832,127 | A * | 5/1989 | Thomas et al. | ..... | 166/369 |
| 5,159,977 | A * | 11/1992 | Zabaras | ..... | 166/105 |
| 5,310,002 | A * | 5/1994 | Blauch et al. | ..... | 166/307 |
| 5,356,565 | A * | 10/1994 | Southwell | ..... | 516/10 |
| 5,554,897 | A * | 9/1996 | Martin et al. | ..... | 310/54 |
| 5,628,616 | A * | 5/1997 | Lee | ..... | 415/58.2 |
| 5,706,895 | A * | 1/1998 | Sydansk | ..... | 166/294 |
| 6,190,141 | B1 * | 2/2001 | Henry | ..... | 417/423.3 |
| 6,364,013 | B1 * | 4/2002 | Watson et al. | ..... | 166/105 |
| 6,595,295 | B1 * | 7/2003 | Berry et al. | ..... | 166/369 |
| 6,668,925 | B2 * | 12/2003 | Shaw et al. | ..... | 166/265 |
| 6,691,782 | B2 * | 2/2004 | Vandevier | ..... | 166/265 |
| 7,241,104 | B2 * | 7/2007 | Wilson et al. | ..... | 415/1 |
| 7,243,726 | B2 * | 7/2007 | Ohmer | ..... | 166/304 |
| 7,249,634 | B2 * | 7/2007 | de Albuquerque Lima Goncalves et al. | .. | 166/335 |
| 7,481,270 | B2 * | 1/2009 | Shepler | ..... | 166/105 |
| 2006/0204359 | A1 * | 9/2006 | Semple et al. | ..... | 415/170.1 |
| 2007/0144738 | A1 * | 6/2007 | Sugiyama et al. | ..... | 166/250.07 |

OTHER PUBLICATIONS

ESP Workshop, Reliable low flowrate centrifugal installations for oil production in complicated conditions, 2005 Society of Petroleum Engineers—Gulf Coast Section Electric Submersible Pump Workshop, Houston, TX, Apr. 27-29, 2005, pp. 1-13.

ESP Workshop, Equipment for producing oil with high free gas content and its field study, 2005 Society of Petroleum Engineers—Gulf Coast Section Electric Submersible Pump Workshop, Houston, TX, Apr. 27-29, 2005, pp. 1-10.

* cited by examiner

*Primary Examiner*—Thomas A Beach
*Assistant Examiner*—Matthew R Buck
(74) *Attorney, Agent, or Firm*—Bracewell & Giuliani LLP

(57) ABSTRACT

A submersible pumping system for use downhole that includes a housing, a pump and gas separator within the housing, a motor for driving the pump and separator, and a foaming agent injection system. The foaming agent injection system injects a foaming agent upstream of the pump and optionally upstream of the separator. The foaming agent injection system comprises a foaming agent supply, an injection pump, and foaming agent injection line.

17 Claims, 4 Drawing Sheets

SUBMERSIBLE PUMP WITH SURFACTANT INJECTION

BACKGROUND

1. Field of Invention

The present disclosure relates to pumping systems submersible in well bore fluids. More specifically, the present disclosure concerns a pumping system having surfactant injected into the fluid being pumped.

2. Description of Prior Art

Centrifugal pumps have been used for pumping well fluids for many years. Centrifugal pumps are designed to handle fluids that are essentially all liquid. Free gas frequently gets entrained within well fluids that are required to be pumped. The free gas within the well fluids can cause trouble in centrifugal pumps. As long as the gas remains entrained within the fluid solution, then the pump behaves normally as if pumping a fluid that has a low density. However, the gas frequently separates from the liquids.

The performance of a centrifugal pump is considerably affected by the gas due to the separation of the liquid and gas phases within the fluid stream. Such problems include a reduction in the pump head, capacity, and efficiency of the pump as a result of the increased gas content within the well fluid. The pump starts producing lower than normal head as the gas-to-liquid ratio increases beyond a certain critical value, which is typically about 10-15% by volume. When the gas content gets too high, the gas blocks all fluid flow within the pump, which causes the pump to become "gas locked." Separation of the liquid and gas in the pump stage causes slipping between the liquid and gas phase which causes the pump to experience lower than normal head. Submersible pumps are generally selected by assuming that there is no slippage between the two phases or by correcting stage performance based upon actual field test data and past experience.

Many of the problems associated with two phase flow in centrifugal pumps would be eliminated if the wells could be produced with a submergence pressure above the bubble point pressure to keep any entrained gas in the solution at the pump. However, this is typically not possible. To help alleviate the problem, gases are usually separated from the other fluids prior to the pump intake to achieve maximum system efficiency, typically by installing a gas separator upstream of the pump. Problems still exist with using a separator upstream of a pump since it is necessary to determine the effect of the gas on the fluid volume in order to select the proper pump and separator. Many times, gas separators are not capable of removing enough gas to overcome the inherent limitations in centrifugal pumps.

A typical centrifugal pump impeller designed for gas containing liquids consists of a set of one-piece rotating vanes, situated between two disk type shrouds with a balance hole that extends into each of the flow passage channels formed by the shrouds and two vanes adjacent to each other. The size of the balance holes vary between pump designs. Deviations from the typical pump configurations have been attempted in an effort to minimize the detrimental effects of gaseous fluids on centrifugal pumps. However, even using these design changes in the impellers of the centrifugal pumps is not enough. There are still problems with pump efficiency, capacity, head, and gas lock in wells producing well fluids with high gas content.

Foaming agents may be added to well fluid to overcome fluid production difficulties associated with gas in the fluid. The vertical flow of fluid from a well depends on the well bottom fluid pressure and the fluid gradient. Oil well flow may start when the wellbore bottom pressure exceeds the static head of the fluid. Continued flow or gushing, may occur because the gas expansion in the upward flowing fluid lightens the fluid column. In some situations, the gas expansion phenomenon is sufficient to lift the fluid even in oil wells having a reduced flow. Injecting a foaming agent to a wellbore fluid can create and maintain a low gradient fluid. The foaming agent plus liquid and gas, combined with the inherent turbulence in fluid flow, forms a low gradient mix as the fluid flows upward in the tubing.

SUMMARY OF INVENTION

The present disclosure includes a downhole submersible pumping system for use in a wellbore comprising a housing, a pump disposed in the housing, a gas separator disposed in the housing upstream of the pump, a fluid inlet formed through the housing and in fluid communication with the gas separator and pump, the fluid inlet configured to receive subterranean connate fluid, a motor mechanically coupled with the pump and gas separator, and a foaming agent injection system in communication with the housing through an injection port. In one embodiment, the foaming agent injection system comprises an injection line having an inlet and an exit terminating at the injection port and an injection pump configured to discharge a foaming agent into the injection line inlet wherein the foaming agent is injected into the connate fluid. Foaming agent injection may occur upstream of the pump or through an injection port formed on the gas separator. The gas separator may include an inducer stage, such as a turbine. The wellbore may be a producing wellbore, or a non-producing wellbore, such as a sub-sea caisson. The pumping system may be disposed in a sub-sea jumper flow line. The foaming agent may comprise a surfactant.

Also disclosed is a method of pumping a fluid with a submersible pump system, the pump system comprising a housing, a pump, a gas separator, and motor disposed in the housing, a fluid inlet, and a foaming agent injection system, wherein the pump and separator are driven by a motor and wherein the fluid is produced from a subterranean wellbore. The method comprising inducing the fluid into the fluid inlet by operating the pump, wherein the fluid comprises liquid and vapor, mixing a foaming agent with the fluid in the housing thereby coalescing the vapor and liquid components of the fluid, and pressurizing the coalesced fluid with the pump.

The method of pumping may involve placing the submersible pump system in a hydrocarbon producing wellbore, in a subsea hydrocarbon producing wellbore, as well as a non-producing wellbore. Optionally, the submersible pump system is disposed in a subsea jumper line.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

The present disclosure concerns a pumping system for pumping fluids produced from a subterranean wellbore. The system and method particularly has uses for fluids having a combination liquid and gas phase. The pumping system and method disclosed herein include injection of a foaming agent within the pumping or pumped fluid for coalescing the vapor within the liquid portion of the fluid. An example of a foaming agent for use with the method and system herein described is found in Sydansk, U.S. Pat. No. 5,706,895, which is incorporated by reference herein in its entirety.

The pumping system further includes mechanical means for coalescing these two phases. As such, the combination of the chemical and mechanical means of disbursing the vapor within the liquid portion produces a homogeneous fluid with a reduced density for enhanced pumping capabilities. Pumping the fluid with foaming agent using an electrical submersible pump pumping system adds mechanical mixing to the chemical mixing of the foaming agent. Mixing the gas and liquid generates additional foam that in turn decreases the fluid gradient within the tubing. Adding the foaming agent reduces the negative effects of pumping a fluid having large bubbles entrained herein. Finally, disbursed bubbles within the liquid creates a situation of fluid flow where the drag force of the fluid is predominant and exceeds the buoyant force of the gas bubbles. Reducing the buoyant force enhances liquid pumping ability. This advantage is further realized by agitating the mixture of produced fluid with foaming agent upstream of the pump inlet.

Figure 1:
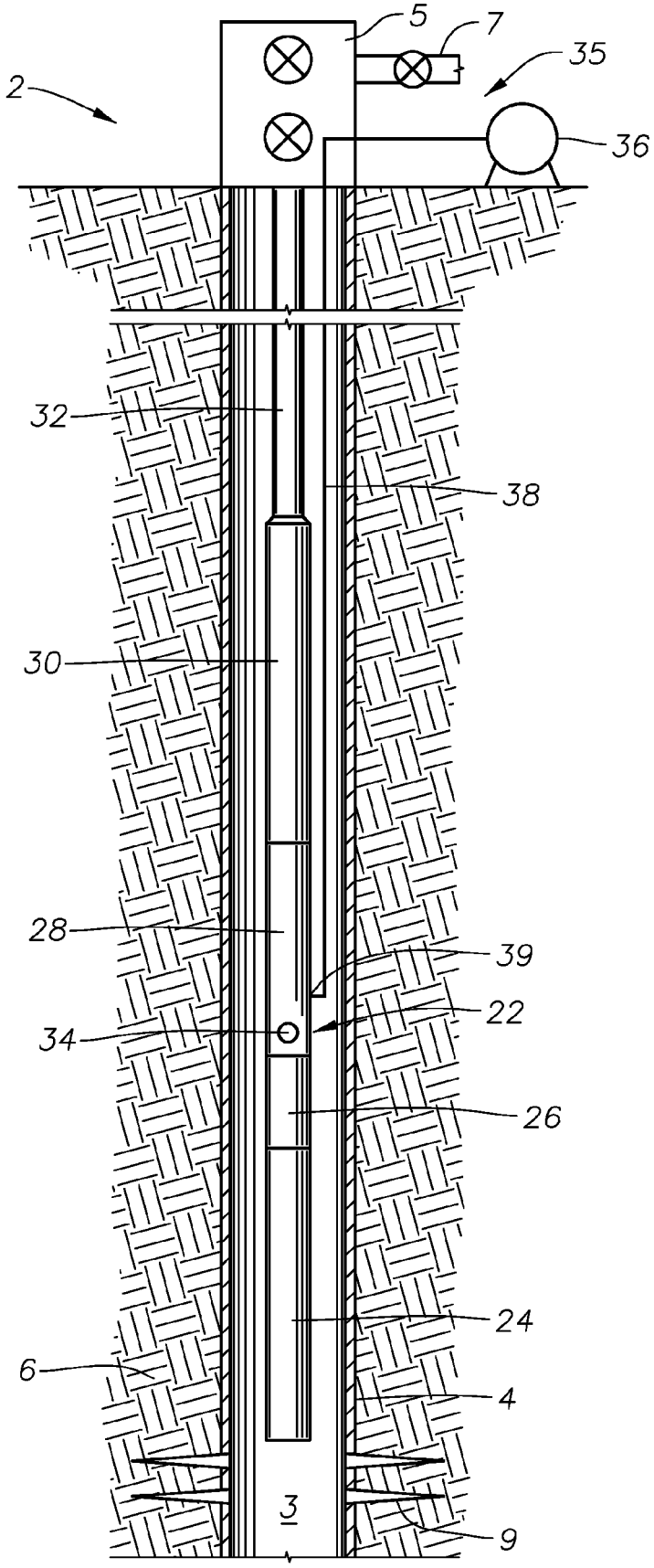
FIG. 1 illustrates an embodiment of an electrical submersible pump disposed in a wellbore.

With reference now to FIG. 1, one example of a pumping system is shown disposed within a wellbore. In this embodiment a producing well 2 is illustrated wherein the well 2 comprises a wellbore 3 formed into subterranean formation 6. The formation 6 is lined with casing 4 on its outer circumference. Perforations 9 extend from within the wellbore through the casing 4 into the formation 6. Disposed atop the producing well 2 is a wellhead 5 formed to receive produced fluids from within the wellbore 3 and distribute them for processing or refining through an associated production line 7.

An electrical submersible pump (ESP) 22 is shown disposed within the wellbore 3. The ESP 22 comprises a motor section 24, an equalizer or seal section 26, a separator section 28, and a pump section 30. This embodiment of the ESP 22 comprises an outer housing extending along the length of the ESP 22. Production tubing 32 extends from the upper end of the ESP 22 and terminates at the wellhead 5. A fluid inlet 34 is formed in the housing in the region of the ESP 22 proximate to the separator section 28. The fluid inlet 34 is configured to receive hydrocarbon fluid produced from within the formation 6 for processing by the ESP 22.

The embodiment of FIG. 1 also includes an injection system 35 coupled with the pumping system for adding a foaming agent to the fluid pumped by the ESP 22. The injection system 35 comprises an injection pump 36 shown disposed at surface and an injection line 38 that provides fluid connectivity between the injection pump discharge 36 and the ESP 22. More specifically, the injection line 38 has an exit terminating into a port 39 formed through the wall of the housing. Injecting the foaming agent into the housing of the pumping system enables mixing of the foaming agent with the fluid to be pumped by the ESP 22. The foaming agent, which may comprise a surfactant, reduces the bubble size of any vapor entrained in the produced fluid thereby producing a more homogenous fluid, which enhances pumping operation of the ESP 22. One example of a suitable foaming agent comprises a mixture of sodium dodecylbenzenesulfonate and water.

Figure 2:
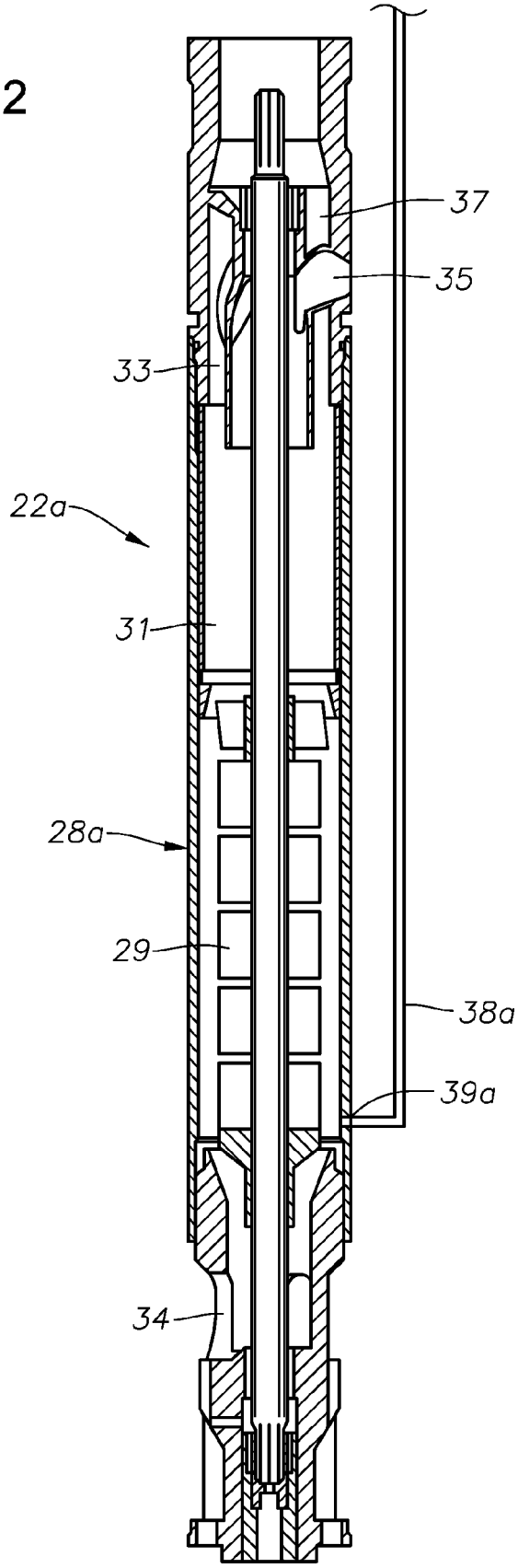
FIG. 2 portrays in cross sectional view an embodiment of a separator portion of an electrical submersible pump.

Foaming agent injection may take place in the ESP 22 within the separator section 28 just upstream of the primary fluid moving device of the separator. Optionally, injection may be positioned just downstream of the primary fluid moving device or can be inserted just upstream of the intake of the pump section 30. With reference now to FIG. 2, one embodiment of the ESP 22*a* is shown in cutaway view illustrating details of the separator section 28*a*. In this embodiment, the separator section 28*a* has a turbine type inducer 29, but it could be other types. A separator drum 31 with vertical blades is located above inducer 29 and also rotatably driven. A crossover 33 at the upper end of separator 28 has a gas exit port 35 and a liquid passage 37. The lighter components exit into casing 4 (FIG. 1) while the heavier components pass upward to pump 30. In the embodiment of FIG. 2, the injection line 38*a* connects to a port 39*a* just upstream of inducing portion 29 of the separator section 28*a*.

Implementation of the system and method herein disclosed is not limited to a producing well but may be inserted in a non producing well, such as a caisson on the sea floor. In this embodiment, produced fluid is directed to a well having an ESP system which pressurizes and treats the fluid for distribution to a different location. An example of this is provided on a side partial cross sectional view in FIG. 3. Here flowline 42 directs fluid received from a manifold or subsea tree 40 into a caisson 11. An ESP 44 disposed in the caisson 11 comprises a manifold or subsea tree 40 into a caisson 11. An ESP 44 disposed in the caisson 11 comprises a pump motor section 46, a seal section 48, and a pump section 50. Production tubing 52 extends from the discharge end of the pump section 50 and provides a conduit for transporting produced fluid from the ESP 44 to a terminal destination (not shown). In this embodiment, the caisson 11 is part of a pressurizing station for overcoming transmission losses from the point of production of the produced fluid to its final destination, normally a floating production vessel.

Figure 3:
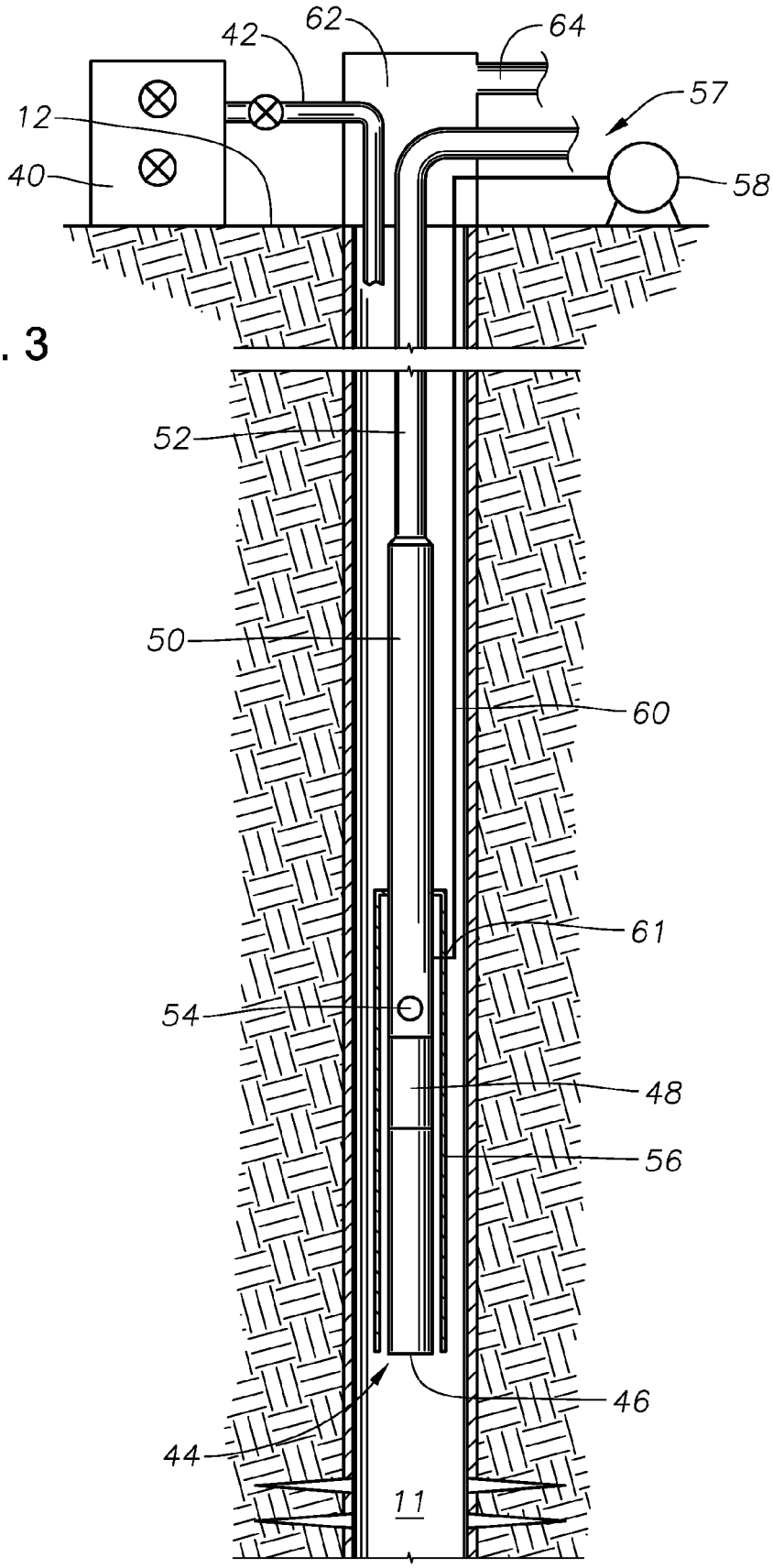
FIG. 3 depicts an embodiment of an electrical submersible pump in a sub sea wellbore.

An injection system 57 is shown included with the pumping system of FIG. 3. The injection system 57 comprises an injection pump 58 coupled with an injection line 60 terminating in a port 61 formed through the wall of the pump section 50. Port 61 is formed in pump section 50 near pump intake 54. The ESP 44 has a shroud 56 that coaxially surrounds the ESP 44 at a point along the pump section 50. The shroud 56 terminates proximate to the lower end of the motor section 46. The presence of the shroud 56 forces fluid flowing into the upper end of caisson to flow downward below the motor section 46 so that fluid drawn into ESP 44 via the fluid inlet 54 will pass over the outer surface of the motor section 46 to provide a cooling effect. Injection line 60 extends through the sidewall of shroud 56 into engagement with port 61.

Caisson 11 serves as a gravity gas separator. The well fluid flows into the upper end of caisson 11. Gas tends to separate and migrate upward in caisson 11, which the liquid is drawn downward into pump 50. Pump 50 in this example does not have a rotary gas separator. Operation of the ESP 44 of FIG. 3 includes injection of a foaming agent via the injection system 57, wherein the foaming agent is mixed with the fluid slightly downstream of where the fluid enters the fluid inlet 54. Due to the configuration of this pumping system, a predominant amount of any gas in the fluid flowing from flowline 42 into the upper end of caisson 11 will likely rise through the caisson 11 and up the corresponding wellhead 62 for delivery to a terminal point via outlet 64. However, a certain amount of gas might be entrained in the liquid entering the fluid inlet 54. Injection of the foaming agent serves to further coalesce this gas and ensure its dispersion within the liquid portion of the fluid being pumped by the ESP 44. Thus, a largely homogeneous fluid is pumped by the ESP 44 into the production tubing 52 for delivery to the terminal point.

Figure 4:
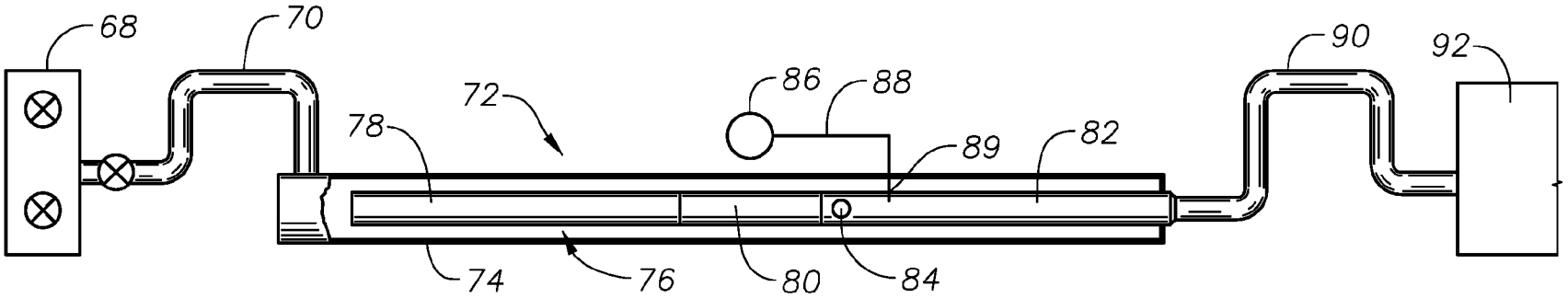
FIG. 4 illustrates a subsea jumper having an embodiment of an electrical submersible pump.

FIG. 4 provides another example of an ESP in accordance with the present disclosure wherein an ESP 76 is disposed within a jumper assembly 72. The jumper assembly 72 provides pressurization for produced hydrocarbons being transmitted from an inlet manifold or subsea tree 68 to an outlet manifold or other subsea equipment 92. A flow line 70 provides fluid communication from the inlet manifold 68 to the jumper assembly 72 and a jumper outlet 90 provides fluid connection between the exit of the jumper assembly 72 and the outlet manifold 92. The jumper assembly 72 comprises a housing 74 in which produced fluid from flow line 70 is received.

ESP 76 may or may not have a rotary gas separator. During operation, the ESP 76 draws fluid into its fluid inlet 84 for pressurization within the pump section 82. A foaming agent is injected into the pumping system through port 89 formed on the pumping section 82 outer housing between the pump inlet and the fluid inlet. An injection pump 86 combined with an injection fluid line serves to provide the foaming agent injection into the ESP 76.

Implementation of the system and method herein disclosed provides many advantages for the pumping of a produced hydrocarbon. A combination of agitating the fluid thereby mechanically coalescing the vapor and liquid with the chemical coalescing means results in a fluid being in a coalesced state for an extended period of time. An additional advantage is that higher quality fluid is segregated in the casing by gravity after it exits from the separator, if a separator is employed. This higher quality fluid will circulate down the annulus within the casing to the separator entrance thereby decreasing the percentage of gas at the entrance to the pumping system. Reduction in the apparent percent of gas at the pumping system entrance reduces the effects of slugs and large bubbles in the fluid.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The invention claimed is:

1. A submersible pumping system for pumping produced well fluid containing liquid and gas, the system comprising:

an electrical submersible pump assembly for submersion within the well fluid, the pump assembly having a gas separator with a well fluid intake;

an injection pump remote from the pump assembly;

a reservoir containing a foaming agent consisting of a liquid only and coupled to an intake of the injection pump; and an injection line leading from the injection pump to the gas separator for injecting the foaming agent into the well fluid as it flows through the gas separator to coalesce gas contained in the well fluid.

2. The pumping system of claim 1 wherein the the injection line is connected to an injection port in the gas separator downstream of the well fluid intake.

3. The pumping system of claim 2, wherein the gas separator has a discharge that discharges a portion of the gas contained in the well fluid to an exterior of the pumping assembly, and a remaining portion of the gas flowing into the gas separator passes into a submersible pump of the pump assembly.

4. The pumping system of claim 1, wherein:

the gas separator has a rotating separator drum with axially extending blades relative to a longitudinal axis of the separator; and wherein the injection line leads to an injection port in the gas separator upstream of the rotating separator drum.

5. The pumping system of claim 1, wherein the gas separator includes a turbine inducer, and the injection line connects to the gas separator at the turbine inducer.

6. The pumping system of claim 1, wherein the foaming agent comprises a surfactant.

7. The pumping system of claim 1, wherein the pumping system is disposed in a subsea jumper flow line.

8. A method of pumping a well fluid containing liquid and gas from a conduit with a submersible pump assembly comprising a centrifugal pump, a motor, and a gas separator, the method comprising:

(a) installing the pump assembly in the conduit and submersing an intake of the pump assembly in the well fluid;

(b) extending an injection line from a remotely located injection pump to the gas separator;

(c) flowing the well fluid into the intake of the pump assembly and operating the pump assembly with the motor to pump the well fluid out of the conduit;

(d) with the injection pump, injecting a foaming agent consisting of a liquid only through the injection line into the pump assembly, and mixing the foaming agent with the gas in the well fluid as the well fluid flows through the gas separator, causing the gas to coalesce with the liquid in the well fluid; and (e) separating gas with the gas separator from liquid in the well fluid, discharging some of the gas into the conduit and delivering a remaining portion of the gas to the centrifugal pump.

9. The method of claim 8, wherein the conduit comprises:

a hydrocarbon producing cased wellbore; and step (a) comprises disposing the pump assembly in the wellbore.

10. The method of claim 8, wherein step (b) comprises extending the injection line to the gas separator downstream of the intake of the pump assembly.

11. The method of claim 10, wherein the gas separator has an inducer and the injection line is connected to the portion of the gas separator containing the inducer.

12. The method of claim 8, wherein the conduit comprises a subsea jumper line; and step (a) comprises disposing the pump assembly in the subsea jumper line.

13. The method of claim 8, wherein the gas separator has a rotating separator drum with blades that extend axially relative to a longitudinal axis of the gas separator, and the injection line is connected to the gas separator upstream of the separator drum.

14. The method of claim 8, wherein step (d) comprises injecting a surfactant as the foaming agent.

15. A method of pumping a well fluid from a caisson disposed in a sea floor, comprising:

(a) mounting a shroud around a centrifugal pump assembly, the shroud having an open lower end, and installing the shroud and pump assembly in the caisson;

(b) extending an injection line from a remotely located injection pump to the shroud;

(c) flowing a well fluid containing liquid and gas into an upper end of the caisson;

(c) operating the pump assembly to draw the well fluid downward alongside the shroud and back up within the shroud to an intake of the pump assembly, and pumping the well fluid out of the caisson; and (d) with the injection pump, injecting a foaming agent consisting of a liquid only through the injection line into the shroud, and mixing the foaming agent with gas contained in the well fluid as the well fluid flows up the shroud, causing the gas to coalesce with the liquid in the well fluid.

16. The method of claim 15, wherein:

step (b) comprises extending the injection line to an injection port on the shroud; and step (d) comprises injecting the foaming agent into an annular space between the shroud and the pump assembly.

17. The method of claim 16, wherein:

step (d) comprises placing the injection port above the intake of the pump assembly.

* * * * *